US005692380A

United States Patent [19]

Cox et al.

[11] Patent Number: 5,692,380

[45] Date of Patent: Dec. 2, 1997

[54] EVAPORATIVE COOLING METHOD

[75] Inventors: Donna R. Cox; Gilbert W. Cox, both of Weare, N.H.

[73] Assignee: Kool Tube, Inc., Weare, N.H.

[21] Appl. No.: 336,337

[22] Filed: Nov. 9, 1994

[51] Int. Cl.[6] ..... F25D 8/00

[52] U.S. Cl. ..... 62/56; 2/181; 2/DIG. 11; 62/259.3; 62/316

[58] Field of Search ..... 62/259.3, 259.4, 62/315, 316, 119, 56; 2/181, DIG. 11, 247

[56] References Cited

U.S. PATENT DOCUMENTS 5,146,630 9/1992 Richard ..... 2/181

*Primary Examiner*—Henry A. Bennett
*Assistant Examiner*—Susanne C. Tinker
*Attorney, Agent, or Firm*—Devine, Millimet & Branch, P.A.

[57] ABSTRACT

An evaporative cooling device and method for removing heat energy from an object in thermally conductive contact with the device that is formed of a flexible and conformable container that is at least partially filled with a liquid absorbing material. When the device is hydrated and placed in thermally conductive contact with an object to be cooled, heat energy is transferred from the object to the device and the liquid that was absorbed by the material is evaporated. The amount of heat transferred is substantially equal to the latent heat of vaporization of the liquid that is evaporated. The use of the liquid absorbing material also allows the container to remain dry to the touch, even after it is hydrated.

4 Claims, 1 Drawing Sheet

EVAPORATIVE COOLING METHOD

BACKGROUND OF THE INVENTION

The present invention relates to a cooling device and method for removing heat energy from an object, and more particularly to a cooling device and method that cools an object through the evaporation of water.

It is commonplace to cool objects through the evaporation of water from cotton cloth or the like. As the water evaporates, the cotton will cool to the wet bulb temperature. For example, one can wrap an object in a piece of cloth that has been immersed in water. The cloth, however, is wet to the touch and may damage other objects it touches because of the excess water in the cloth. Alternatively, if enough water is removed from the cloth to avoid these problems, the amount of water remaining on the cloth provides a relatively short time of evaporation. In addition, the cloth, and other substances, in common use do not have an attractive tactile response.

SUMMARY OF INVENTION

Accordingly, it is an object of the invention to provide an evaporative cooling device that will appear substantially dry to the touch and will absorb sufficient water to provide a relatively long time of evaporation.

It is a further object of the invention to provide an evaporative cooling device that has attractive tactile properties.

It is yet a further object of the invention to provide an evaporative cooling device and method that is simple to operate and inexpensive to manufacture.

The above and related objects of the present invention are obtained in an evaporative cooling device for removing heat energy from an object in thermally conductive contact with the device. The device itself is made up of a flexible and conformable closed container formed of a liquid-permeable material that is at least partially filled with a liquid absorbing material. When the device is hydrated with a liquid and placed in thermally conductive contact with an object to be cooled, an amount of energy that is substantially equal to the amount of energy required to evaporate the liquid from the liquid absorbing material is removed from the object being cooled, preferably through the process of conduction. All the while, the container containing the liquid absorbing material remains substantially dry to the touch.

DESCRIPTION OF THE PREFERRED EMBODIMENTS

Figure 1:
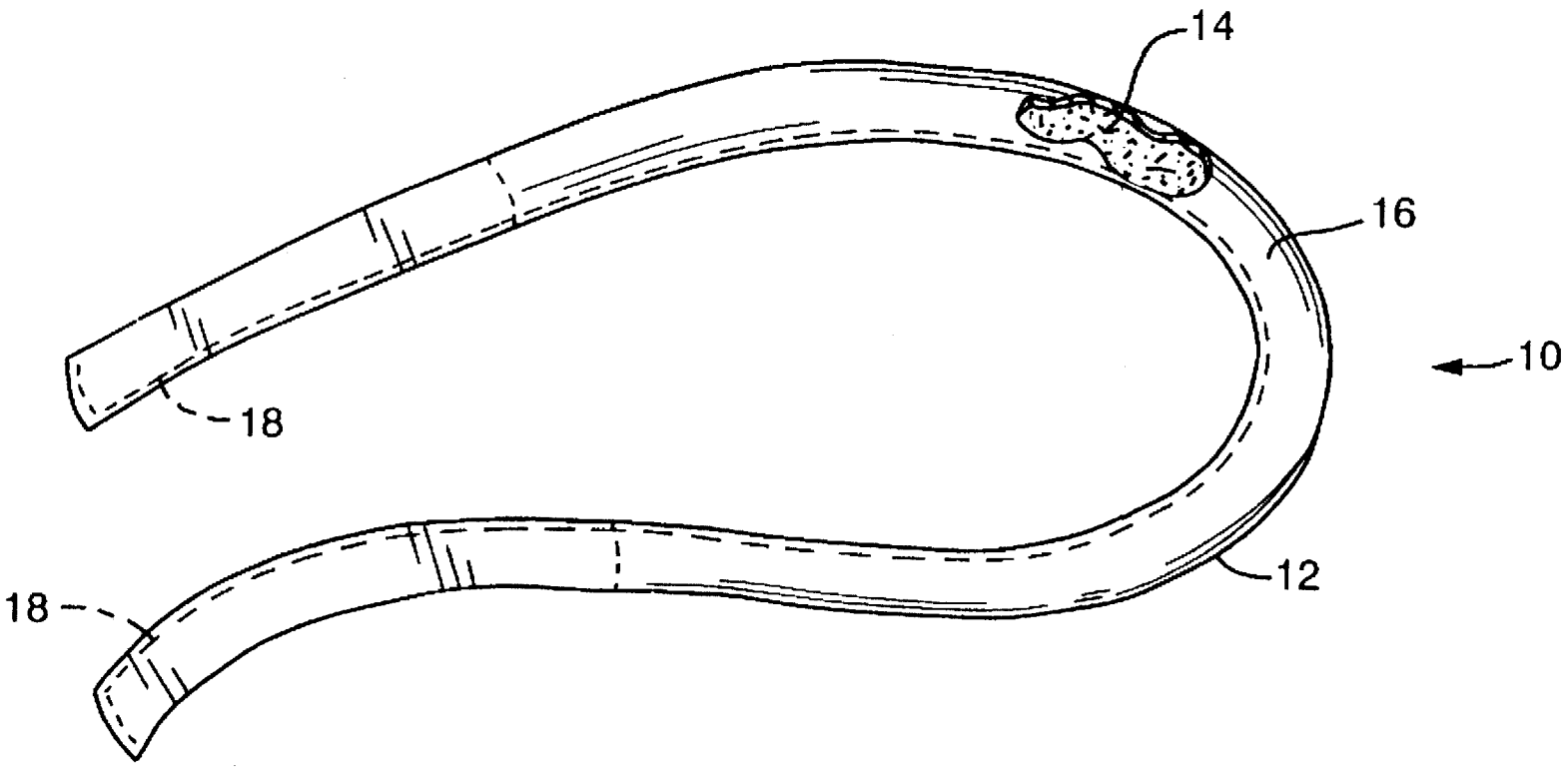
FIG. 1 is a representation of one use of the disclosed invention, specifically, an evaporative cooling device headband, with portions thereof removed to reveal the details of the internal construction.

Referring now to FIG. 1, therein is illustrated one preferred embodiment of the disclosed evaporative cooling device, generally designated by the reference numeral 10. The evaporative cooling device 10, which can be used to remove heat energy from an object in thermally conductive contact with said device, comprises a flexible and conformable closed container 12 formed of a liquid-permeable material and at least partially filled with a liquid absorbing material 14. The container 12 can be made of any material that will allow liquid to pass therethrough but will, at the same time, retain the liquid absorbing material therein. The inventors have found that the preferred container material is a fabric such as cotton. The container may be formed from a single piece of material, which may be sewn, or otherwise secured together along at least one margin to define at least one closed pocket 16. If desired, the closed pocket 16 may extend beyond the closed pocket 16 and comprise extensions 18 that contain little or no liquid absorbing material. These extensions 18 may be used to secure the evaporative cooling device in position, for example, by tying the extensions into a knot or the like.

The closed pocket 16 is at least partially filled with a liquid absorbing matter 14. Any conventional liquid absorbing matter 14 may be used with a copolymer polyacrylamide being especially preferred. If necessary, the matter may be pulverized to provide matter of suitably small dimension such that even if each individual particle of particulate matter is rigid and inflexible, the partially filled pocket 16 as a whole remains flexible and conformable due to the small size of the particles and their ability to flow past one another within the pocket 16. Thus, the evaporative cooling device 10 easily conforms to the shape of the surface of the object upon which it is placed, thereby establishing good thermally conductive contact with the object.

To use the evaporative cooling device, it is at least partially hydrated with a liquid, and preferably hydrated to saturation. The hydration process can generally be accomplished by immersing the device in a volume of liquid, such as a sink filled with water. When introduced into the body of water, water passes through the liquid permeable container material and is absorbed by the particulate matter 14 within pocket 16. When the device is removed from the body of water, the liquid absorbing particulate matter absorbs the liquid remaining in the liquid permeable container material so that the container itself remains dry to the touch and does not change the object to be cooled. Once the evaporative cooling device is hydrated, it is placed in thermally conductive contact with an object to be cooled. Such contact is preferably direct physical contact. As shown by the preferred embodiment of FIG. 1, the device may take the form of a headband and thus cool the brow of a person whilst working in a relatively hot environment.

While the device is in contact with the object being cooled, heat energy is transferred from the object through the container walls and to the liquid absorbing material where it will evaporate a given amount of water from the material. As the water evaporates, an amount of energy substantially equal to the latent heat of vaporization of the evaporated water is removed from the object. This transfer of heat from the object is primarily through conduction.

To summarize, the present invention is an evaporative cooling device for removing heat energy from an object in thermally conductive contact with the device that is formed of a flexible and conformable container that is at least partially filled with a liquid absorbing material. When the device is hydrated and placed in thermally conductive contact with an object to be cooled, heat energy is transferred from the object to the device, primarily through conduction and evaporates an amount of liquid from the liquid absorbing material. The amount of heat transferred is substantially equal to the latent heat of vaporization of the liquid that is evaporated. The use of the liquid absorbing material also allows the container to remain dry to the touch after it is hydrated.

Accordingly, the appended claims should be construed broadly and in a manner consistent with the spirit and scope of the invention disclosed herein.

We claim:

1. An evaporative cooling method for removing heat energy from an object comprising the steps of encasing a liquid absorbing material in a closed container formed of a liquid-permeable material and at least partially filled with a liquid absorbing material, hydrating said container by immersing said container in a volume of liquid, removing said container from said volume of liquid, allowing said liquid absorbing material to absorb the liquid remaining in said liquid permeable container material, and placing said hydrated container in thermally conductive contact with said object to allow said object to be cooled by allowing an amount of energy substantially equal to the amount of energy required to evaporate said liquid from said liquid absorbing material to be removed from said object through conduction, wherein said container remains dry to the touch while said container is in contact with said object.

2. The evaporative cooling method of claim 1, wherein said liquid absorbing material is co-polymer polyacrylamide.

3. The evaporative cooling method of claim 2, wherein said hydrating is accomplished by immersing said encased liquid absorbing material in water.

4. The evaporative cooling method of claim 1, wherein said object to be cooled is a part of the human body.

* * * * *